US009216487B1

(12) United States Patent
Dovel

(10) Patent No.: US 9,216,487 B1
(45) Date of Patent: Dec. 22, 2015

(54) MANUAL TOOL SHARPENER WITH MOVEABLE ABRASIVE SURFACE

(71) Applicant: Darex LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 14/542,122

(22) Filed: Nov. 14, 2014

(51) Int. Cl.
*B24B 3/54* (2006.01)
*B24B 3/36* (2006.01)
*B24D 15/08* (2006.01)

(52) U.S. Cl.
CPC .. *B24B 3/36* (2013.01); *B24D 15/08* (2013.01)

(58) Field of Classification Search
CPC ..... B24B 3/36; B24B 3/54; B24D 15/08
USPC ..... 451/555, 552, 45; 76/81, 81.1, 81.2, 76/81.5, 81.6
See application file for complete search history.

(56) References Cited

U.S. PATENT DOCUMENTS

| | | | | | |
|---|---|---|---|---|---|
| 269,409 | A | * | 12/1882 | Gowell | 451/552 |
| 525,631 | A | | 9/1894 | Simmons | |
| 865,495 | A | * | 9/1907 | Hensley | 76/81 |
| 973,968 | A | | 10/1910 | Pike | |
| 1,479,030 | A | * | 1/1924 | Dobbins | 76/81.6 |
| 1,696,778 | A | * | 12/1928 | Pascoo | 76/81 |
| 2,114,410 | A | * | 4/1938 | Walker | 451/554 |
| 2,267,555 | A | * | 12/1941 | Dohnal | 76/81.2 |
| 2,398,711 | A | | 4/1946 | Lambert | |
| 2,652,667 | A | * | 9/1953 | Arnold | 451/555 |
| 3,412,508 | A | | 11/1968 | Schell, Jr. | |
| 4,512,112 | A | | 4/1985 | LeVine | |
| D287,095 | S | | 12/1986 | Hunter | |
| 4,903,438 | A | | 2/1990 | Smith | |
| 5,458,534 | A | * | 10/1995 | Campione et al. | 451/555 |
| 6,454,642 | B1 | | 9/2002 | Fierus et al. | |
| 7,229,345 | B2 | | 6/2007 | Fierus et al. | |
| 8,221,199 | B2 | | 7/2012 | Smith | |
| 2010/0304646 | A1 | | 12/2010 | Lytinas | |
| 2014/0120812 | A1 | | 5/2014 | Smith et al. | |

FOREIGN PATENT DOCUMENTS

| | | |
|---|---|---|
| WO | 01/78852 A1 | 10/2001 |

* cited by examiner

*Primary Examiner* — Robert Rose
(74) *Attorney, Agent, or Firm* — Hall Estill Attorneys at Law

(57) ABSTRACT

Apparatus and method for sharpening a cutting tool having a cutting edge. In some embodiments, a manual sharpener includes a base housing adapted to be contactingly supported on a base surface, with the base housing having an overall length dimension in a first direction. A support member extends along the overall length dimension of the base housing and is adapted for rotation with respect to the base housing about a central axis extending along the first direction. An abrasive surface covers a top surface of the support member. The support member rotates the abrasive surface responsive to presentation of the cutting edge of the tool thereagainst as the cutting edge is moved along the abrasive surface in the first direction. A biasing mechanism coupled to the support member urges the support member to a neutral rotational position with respect to the base housing.

25 Claims, 11 Drawing Sheets

MANUAL TOOL SHARPENER WITH MOVEABLE ABRASIVE SURFACE

BACKGROUND

Cutting tools are used in a variety of applications to cut or otherwise remove material from a workpiece. A variety of cutting tools are well known in the art, including but not limited to knives, scissors, shears, blades, chisels, spades, machetes, saws, drill bits, etc.

A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use. It can thus be desirable to subject a dulled cutting tool to a sharpening operation to restore the cutting edge to a greater level of sharpness. A variety of sharpening techniques are known in the art, including the use of grinding wheels, whet stones, abrasive cloths, etc. While these and other sharpening techniques have been found operable, there is a continued need for improvements in the manner in which various cutting tools may be sharpened.

SUMMARY

Various embodiments of the present disclosure are generally directed to an apparatus and method for sharpening a cutting edge of a tool.

In some embodiments, a manual sharpener includes a base housing adapted to be contactingly supported on a base surface, with the base housing having an overall length dimension in a first direction. A support member extends along the overall length dimension of the base housing and is adapted for rotation with respect to the base housing about at least one central axis extending along the first direction. An abrasive surface covers a top surface of the support member. The support member rotates the abrasive surface responsive to presentation of the cutting edge of the tool thereagainst as the cutting edge is moved along the abrasive surface in the first direction. A biasing mechanism coupled to the support member urges the support member to a neutral rotational position with respect to the base housing.

These and other aspects of various embodiments of the present disclosure will become apparent from a review of the following detailed description in conjunction with the accompanying drawings.

DETAILED DESCRIPTION

Figure 1A:
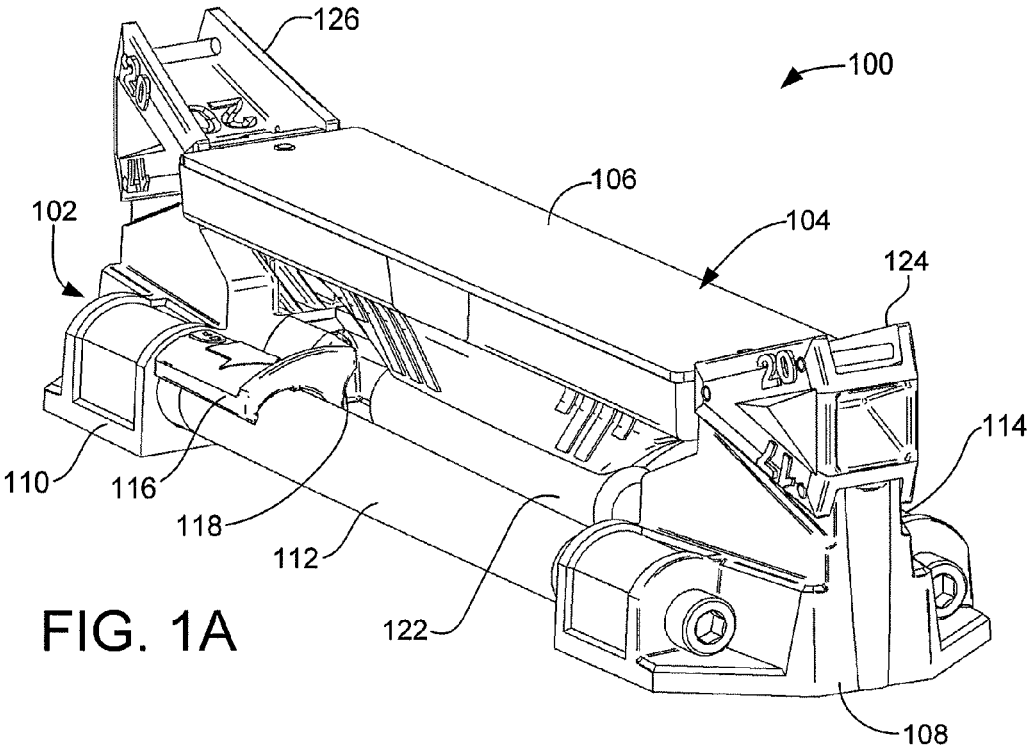
FIGS. 1A-1G show various isometric views of a tool sharpener having a moveable abrasive surface in accordance with some embodiments of the present disclosure.
Figure 1B:
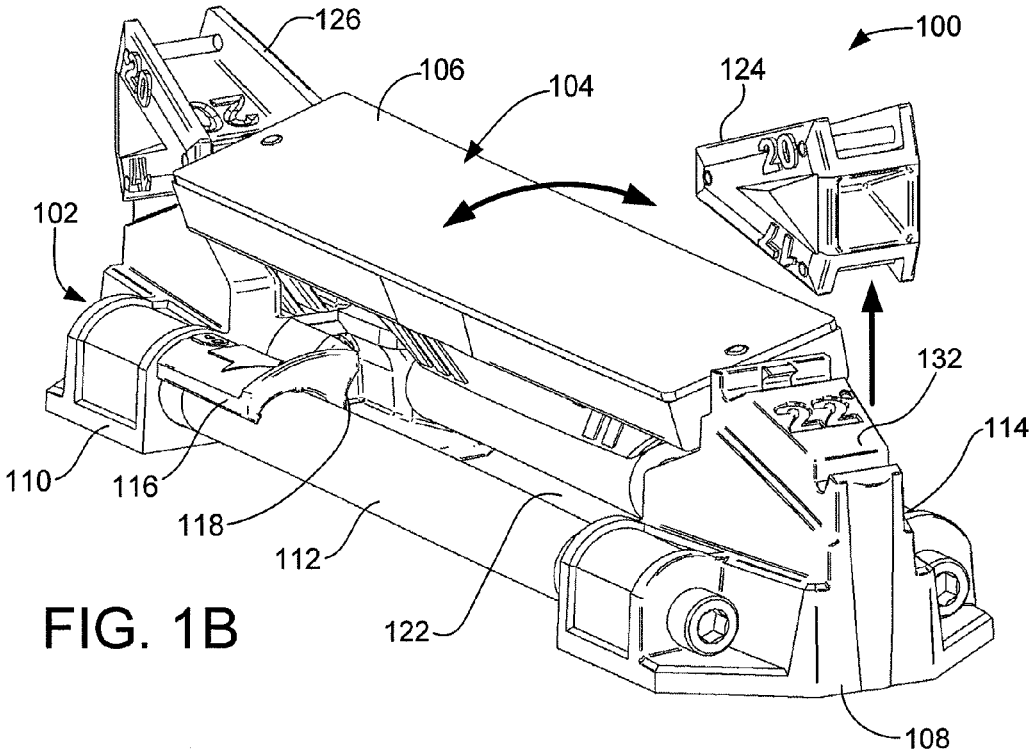

Various embodiments of the present disclosure are generally directed to an apparatus and method for sharpening the cutting edge of a tool using a manual sharpening with a moveable abrasive surface.

A variety of sharpening mechanisms have been developed to sharpen the cutting edge of a cutting tool, such as a knife. These mechanisms can be broadly classified as powered sharpeners and manual sharpeners. Powered sharpeners generally refer to a class of sharpeners that utilize motive power, such as an electric motor, to move an abrasive surface relative to the cutting edge of a tool in order to carry out a sharpening operation thereon. By contrast, manual sharpeners rely on human-supplied power to generate relative movement between the tool and the cutting surface.

One commonly employed manual sharpener is a sharpening stone. To sharpen a knife or other cutting tool using a sharpening stone, the stone is held in the palm of a first hand of a user while a second hand of the user draws the cutting edge of the tool across an abrasive surface of the stone. Sharpening stones can take a variety of forms, from specially manufactured rectilinearly shaped abrasive blocks to literal stones procured from the wild.

Sharpening stones have been used for millennia to effectively sharpen various cutting tools. Nevertheless, a common problem encountered by this ancient method is maintaining the bevel angle of the tool relative to the stone while following the profile of the cutting edge. Many cutting tools, such as knives, swords, hooks, etc. are provided with a blade portion that extends from a handle portion. The blade portion usually has a cutting edge profile that varies along the length of the blade. Manually directing a stone along this profile consistently over multiple repeated passes can be difficult to master.

Other manual sharpeners of the existing art include a base housing that in turn supports a sharpening stone, plate or other support member having an abrasive surface. The housing is bench mounted to maintain the abrasive surface in a fixed, rigid position while the user draws the cutting edge of the tool across the abrasive surface.

This fixed construction generally requires the user to manually orient the blade by lifting or lowering the handle of the tool to maintain the blade in uniform contact with the abrasive surface. This can be challenging to do while concurrently maintaining the blade at a consistent angle against the abrasive surface.

Long, straight tools with relatively thick blades and large bevel angles, such as chisels and the like, can be sharpened against a stationary abrasive surface in a relatively easy manner. Thinner, straight blades with relatively smaller bevel angles are more difficult to sharpen at a consistent angle. Curved blades add another layer of complexity to the sharpening operation because the user is generally required to reorient the blade while advancing the blade against the abrasive surface. Some sharpener designers have attempted to address this latter issue by providing a curved abrasive surface. While improving the consistency of sharpening curved blades, a curved abrasive surface makes it more difficult to sharpen a tool having a straight blade without rounding the end of the blade.

Regardless whether a fixed abrasive surface is flat or curved, variations in surface pressure can introduce significant errors in the sharpening process. Generally, a fixed abrasive surface provides equal force opposing the force applied by the user as the tool is pressed against the abrasive surface. Because most cutting tool blades are curved, the area of contact between the cutting edge and the abrasive surface will tend to decrease substantially when sharpening curved portions of a blade.

Surface pressure P is equal to force F over area A (e.g., $P=F/A$), so the surface pressure will tend to increase significantly for different portions of the blade even if the user applies a constant force upon the tool. Significant variations in surface pressure during sharpening will result in different amounts of material being removed along the length of the blade. Excessive surface pressure on the curved portions of a blade can also lead to excessive burr formation or even damage to the blade itself.

Accordingly, various embodiments of the present disclosure are generally directed to an apparatus and method for sharpening a cutting edge of a tool using a moveable abrasive surface during a manual sharpening process.

As explained below, some embodiments generally provide a sharpener with a base housing adapted to be contactingly supported on a base surface. A support member is coupled to and supported by the base housing, the support member adapted for rotation with respect to the base housing about a central axis that generally extends is a direction of a length dimension of the base housing and having a biasing mechanism that tends to urge the support member to a neutral position, such as along a nominally horizontal plane.

An abrasive surface covers a top surface of the support member. The support member rotates the abrasive surface responsive to presentation of a cutting edge of a tool thereagainst as the cutting edge is moved along the abrasive surface.

The rotational movement of the support member is induced by the force applied by the user as the tool is presented against the abrasive surface. This can allow the user to maintain nominally consistent surface pressure upon the tool irrespective of how much, or how little, of the cutting edge is in contacting engagement against the abrasive surface. The rotation of the abrasive surface limits the practical force that can be applied during the sharpening process and provides an upper limit to the amount of surface pressure that can be realistically applied to the tool.

These and other features and advantages of various embodiments disclosed herein can be understood beginning with a review of FIGS. 1A-1G, which show various views of a manual tool sharpener 100 adapted to sharpen the cutting edge of a tool. The sharpener 100 includes a base housing 102 and a support member 104 supported by the base housing. The support member 104 supports an abrasive surface 106 on a top portion thereof. As explained below, the support member 104, and hence the abrasive surface 106, are rotatable with respect to the base housing 102. These elements rotate during a sharpening operation to limit the amount of surface pressure applied to the tool being sharpened and to follow the profile of the tool being sharpened.

The housing 102 includes opposing first and second ends 108, 110. The ends are mutually supported by a pair of cylindrical support rods 112, 114. The rods maintain the ends 108, 110 at a selected separation distance. The rods further serve to facilitate sliding engagement of a locking member 116 that can be deployed between a locked position (see e.g., FIGS. 1E and 1G) and an unlocked position (see, e.g., FIGS. 1C and 1D). For reference, arrows 117A (FIGS. 1E and 1G) denote the direction of sliding of the member 116 to the locked position, and arrow 117B (FIG. 1D) denotes the direction of sliding of the member 116 to the unlocked position.

The locking member 116 includes a groove with opposing limit stops 118, 120 that serve to limit the overall rotational extent of the abrasive surface 106 in the unlocked position. The limit stops form opposing sides of a tapered channel that narrows along its length so that, in the locked position, the limit stops 118, 120 contactingly engage a lower counterweight member 122 of the support member 104 to lock the abrasive surface 106 in a nominally horizontal position to the housing 102. The locked position is suitable for storage of the sharpener 100 as well as for sharpening operations in which rotation of the abrasive surface is undesired.

Figure 1C:
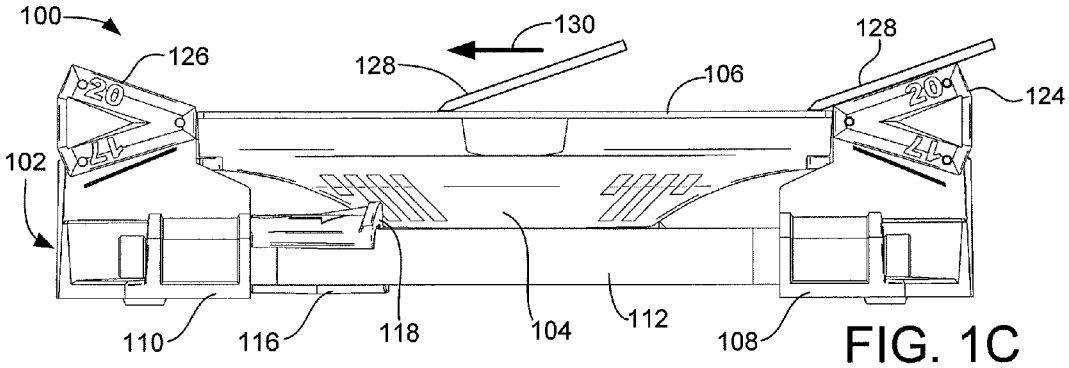
Figure 1D:
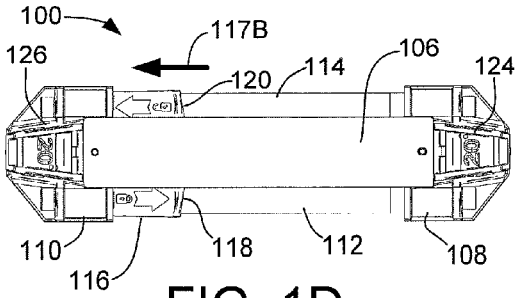
Figure 1E:
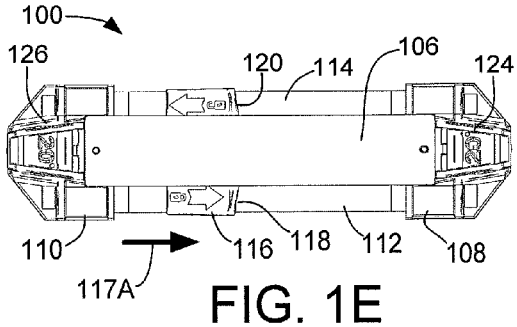
Figure 1F:
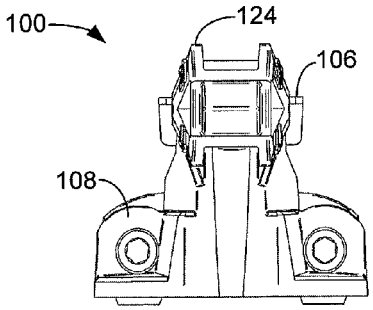

A pair of reversible upper guides 124, 126 are coupled to the respective ends 108, 110 of the base housing 102. The reversible upper guides provide a reference angle for the user during a sharpening operation. As depicted in FIG. 1C, the user places a side of a cutting tool 128 against a selected one of the guides (in this case, guide 124) to align a cutting edge of the tool 128 against the abrasive surface 106. The user then advances the tool 128 across the abrasive surface 106 in direction 130, corresponding to a so-called leading edge configuration. The term "leading edge" refers to the fact that the cutting edge is generally pointing in the direction of travel (arrow 130).

The guides 124, 126 are removable to expose a pair of lower guides on the base housing 102. One of the lower guides is denoted at 132 in FIG. 1B. The lower guides similarly provide a reference angle for the user during a sharpening operation. As before, the user places a side of the cutting tool against a selected one of the lower guides and then advances the tool 128 up the guide and along the abrasive surface in a so-called trailing edge configuration. The term "trailing edge" refers to the fact that the cutting edge is generally pointing away from the direction of travel. This can be envisioned in FIG. 1C assuming that the cutting tool 128 is being advanced in the direction opposite arrow 130.

The reverse guides are particularly suitable for softer abrasives, such as a leather strop since the cutting edge of the tool 128 will be less likely to cut into the abrasive material. However, both leading and trailing edge sharpening operations can be carried out with any number of suitable abrasive characteristics.

Referring again to the reversible upper guides 124, 126, it will be noted that each side of the guides presents a different bevel angle with respect to the abrasive surface. The embodiment of FIGS. 1A-1G provides respective angles of nominally 17 degrees and 20 degrees (and a reverse angle guide at nominally 22 degrees). Other suitable angles can be used. In some embodiments, multiple sets of the sharpening guides 124, 126 can be supplied with different angles to enable the user to select an appropriate angle for a given sharpening operation.

Figure 1G:
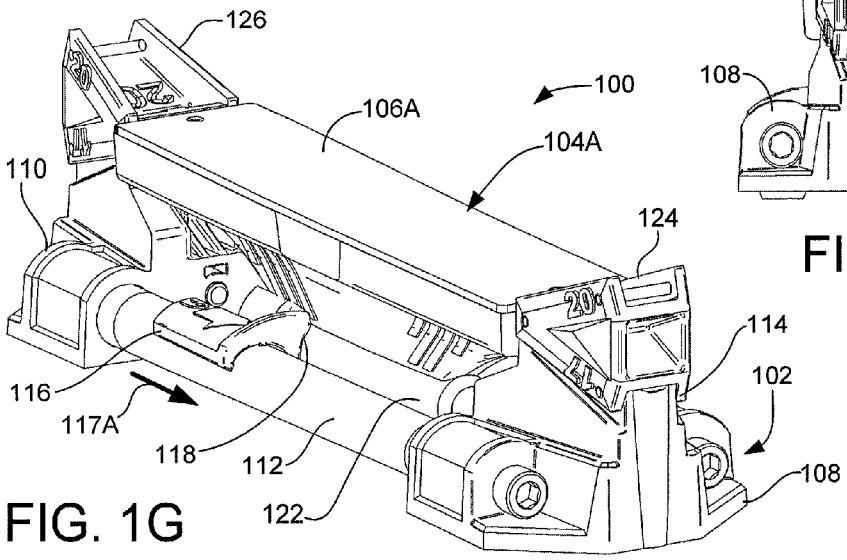

Finally, it is noted that the support member 104 can be configured to be replaceable so that a number of different support members with different abrasive surfaces can be sequentially mated with the base housing. By way of illustration, the support member 104 in FIG. 1C is contemplated as comprising a first abrasive surface 106 with a first, relatively coarse level of abrasiveness. FIG. 1G shows a second support member 104A with a second abrasive surface 106A having a second, relatively fine level of abrasiveness. This can allow multi-stage sharpening operations where a coarse grind operation is initially carried out to shape the tool, followed by a fine (honing) grind operation to polish and finish the sharpening of the tool.

FIGS. 2A-2D illustrate another manual sharpener 200 generally similar to the sharpener 100 discussed above. The sharpener 200 is somewhat simplified for purposes of illustration, but it will be understood that the various features discussed above, such as the locking feature, the limit stops, the upper and lower guides, etc. can be readily incorporated into the sharpener 200 as desired.

Generally, the sharpener includes a base housing 202 and a support member 204 with an abrasive surface 206. The support member 204 and abrasive surface 206 are rotatable about a shaft 208 to facilitate movement relative to the base housing 202.

Figure 2A:
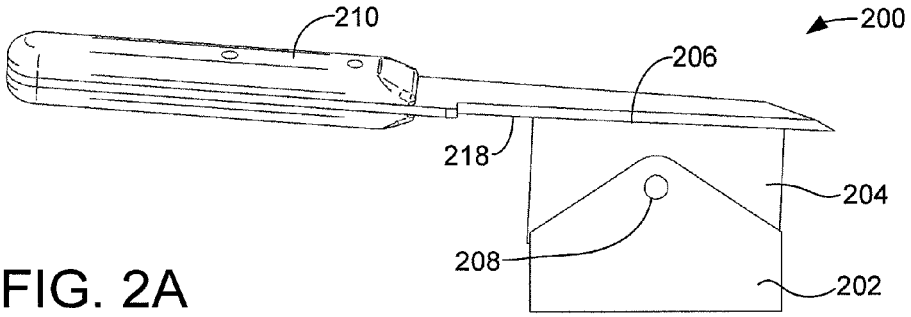
FIGS. 2A-2D show side elevational schematic representations of a simplified tool sharpener similar to that of FIGS. 1A-1B during different sharpening operations.
Figure 2B:
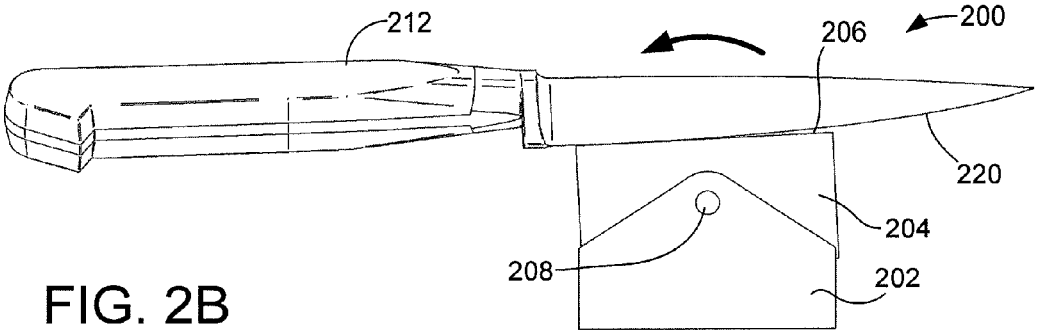
Figure 2C:
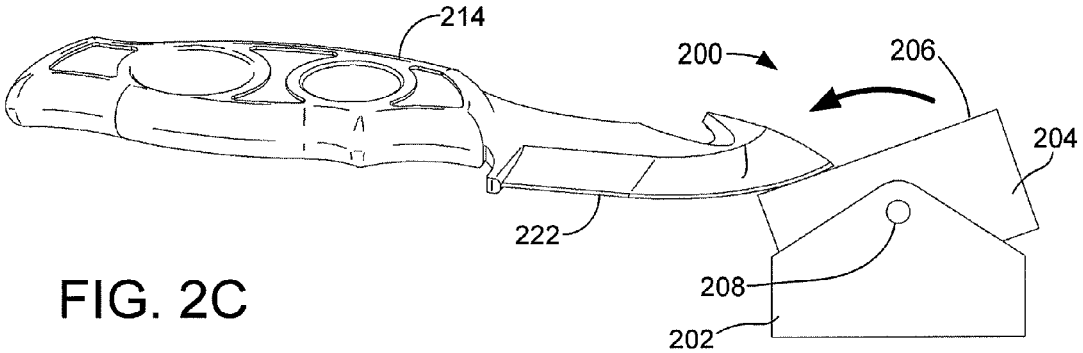
Figure 2D:
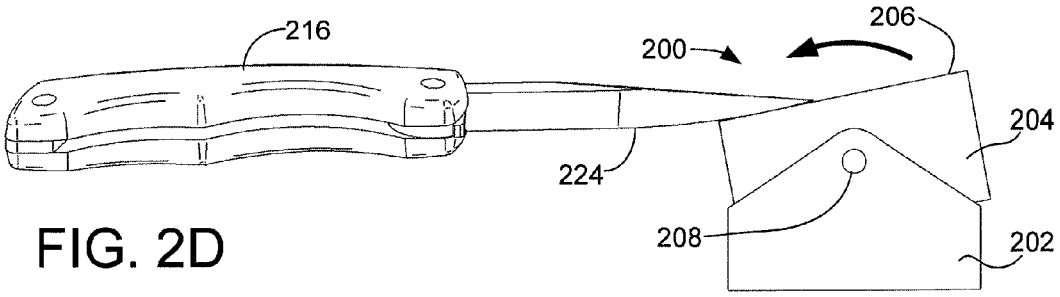

Respective cutting tools 210, 212, 214 and 216 are shown during different sharpening operations using the sharpener 200. The cutting tool 210 in FIG. 2A is a kitchen knife with a straight (nominally linear) cutting edge 218. The cutting tool 212 in FIG. 2B is a kitchen knife with a curved (nominally curvilinear) cutting edge 220. The cutting tool 214 in FIG. 2C is a utility knife with a complex curvilinear cutting edge 222. The cutting tool 216 is a utility knife with a simple curvilinear cutting edge 224. It can be seen from a review of FIGS. 2A-2D that these various knifes impart different amounts of rotation to the abrasive surface 206 during the respective sharpening operations. The amount of rotation is governed at least in part by the relative location of the contact portion of the cutting edge with respect to the axis of rotation defined by the shaft 208.

Figure 3A:
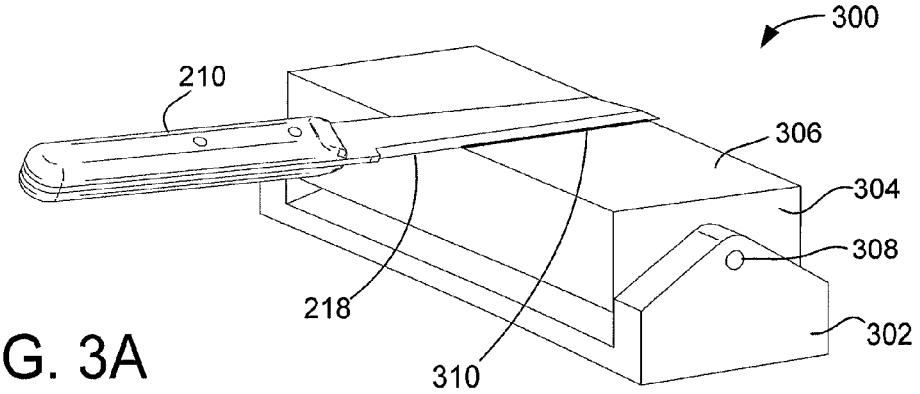
FIGS. 3A-3C are isometric depictions of the tool sharpener of FIGS. 2A-2D during different sharpening operations.
Figure 3B:
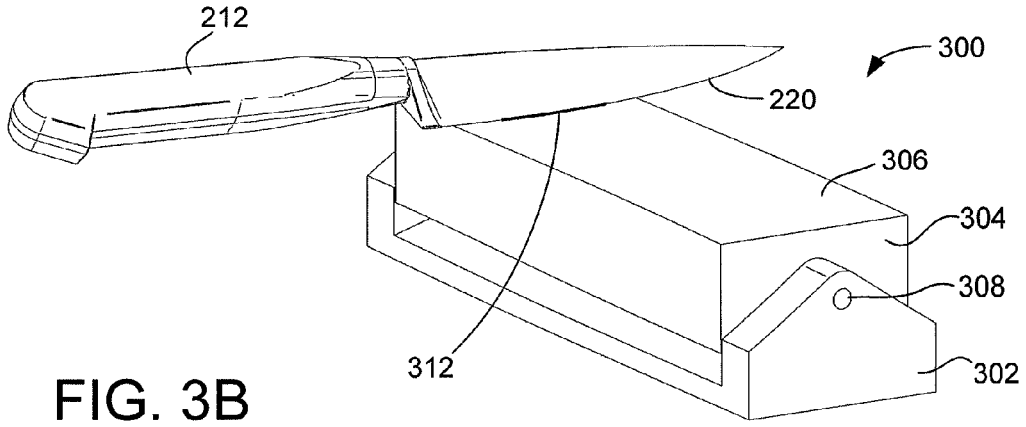
Figure 3C:
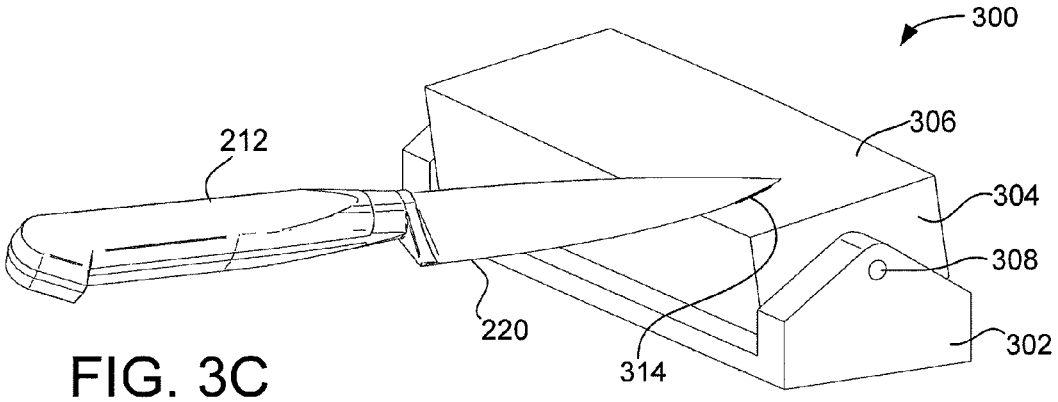

FIGS. 3A-3C illustrate another manual sharpener 300 similar to the simplified sharpener 200 of FIG. 2. The sharpener 300 includes base housing 302, support member 304, abrasive surface 306 and shaft 308. The cutting tool 210 from FIG. 2A is shown in FIG. 3A, and the cutting tool 212 from FIG. 2B is shown in FIGS. 3B and 3C.

A series of thick, heavy lines are denoted at 310, 312 and 314. The length of each of the lines 310, 312 and 314 indicates the amount of the associated cutting edge that is nominally in contact with the abrasive surface 306. For example, the line 310 in FIG. 3A indicates that a substantial portion of the cutting edge 218 of tool 210 is in contact with the abrasive surface. The line 312 in FIG. 3B indicates that a smaller portion of the cutting edge 220 of the tool 212 along a medial portion of the cutting edge is in contact with the abrasive surface. The line 314 in FIG. 3C indicates that a still smaller portion of the cutting edge 220 of the tool near a distal end thereof is in contact with the abrasive surface.

It is contemplated that the user applies a nominally consistent amount of force that is further limited by the movement of the support member as the respective tools 210, 212 are drawn along and across the axial length of the abrasive surface 306. The thickness of each of the lines 310, 312 and 314 represents the amount of surface pressure applied to the respective tools during the sharpening operations. It can be seen that the abrasive surface 306 rotates in relation to the overall amount of contact area so that the surface pressure (e.g. line thickness) is nominally equal in each case.

In this way, as a user sharpens a tool having a curvilinearly shaped cutting edge, the abrasive surface rotates in relation to the curvilinear shape in a way similar to the use of a hand-held sharpening stone, but with greater repeatability over respective strokes. It is contemplated that in each case the abrasive surface will return to a neutral position, such as the horizontal position represented in the drawings, between each stroke. Various biasing mechanisms used to impart this centering of the rotatable abrasive surface will now be discussed, beginning with FIGS. 4A-4E which shows a sharpener 400 in accordance with further embodiments.

The sharpener 400 is similar to the sharpeners 100, 200 and 300 discussed above and includes a base housing 402, rotatable support member 404, abrasive surface 406 and shaft 408. The support member 404 includes a counterweight 410 similar to the counterweight 122 of sharpener 100. Generally, the counterweight 410 is sized and shaped to urge the abrasive surface 406 to return to the neutral position (in this case, a horizontal orientation) at the conclusion of each stroke. The counterweight 410 also provides a desired reactive force during sharpening to resist the rotation of the abrasive surface by counteracting the applied force from the user.

Figure 4A:
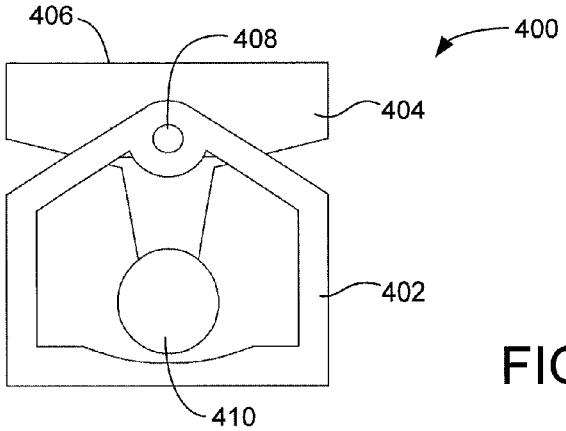
FIG. 4A is a side elevational representation of another tool sharpener similar to those of FIGS. 1A-3C using a single pivot and gravity bias for a moveable support member that supports an abrasive surface.
Figure 4B:
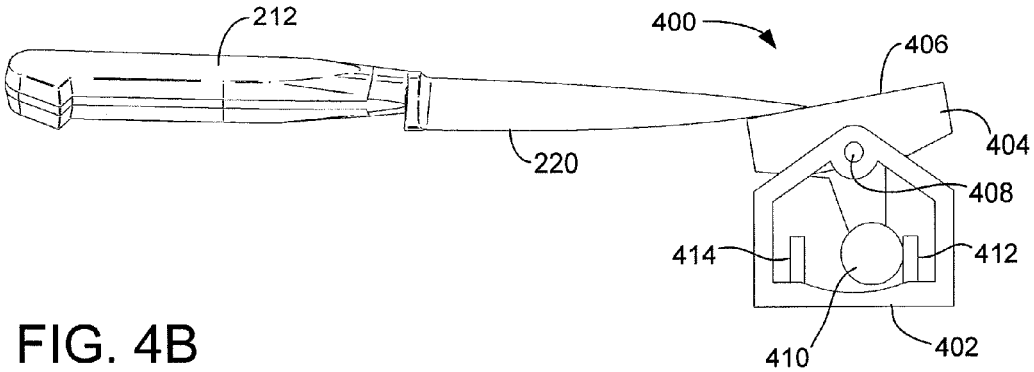
FIGS. 4B-4C illustrate opposing sharpening operations to a selected cutting tool using the sharpener of FIG. 4A in accordance with some embodiments.
Figure 4C:
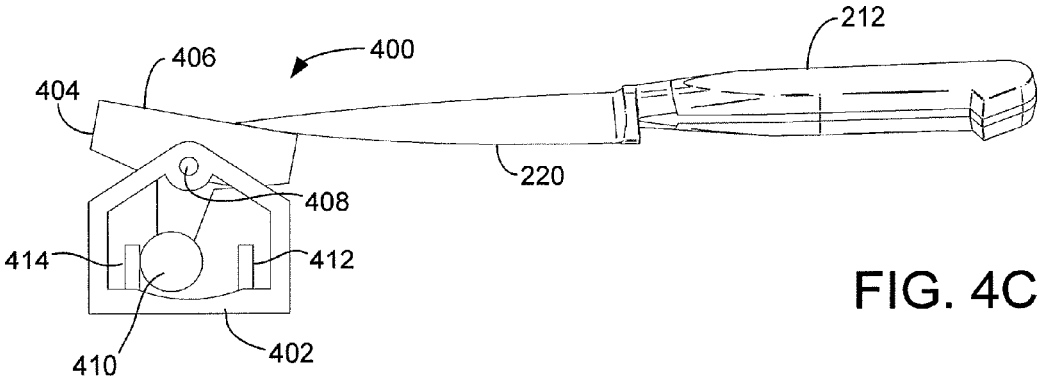

FIGS. 4B and 4C illustrate sharpening operations using the cutting tool 212 carried out on opposing sides of the abrasive surface 406. Limit stops 412, 414 operate to limit the maximum rotational displacement of the abrasive surface. The limit stops are merely exemplary and are not necessarily required in any embodiment disclosed herein, although such can be incorporated as desired.

Figure 4D:
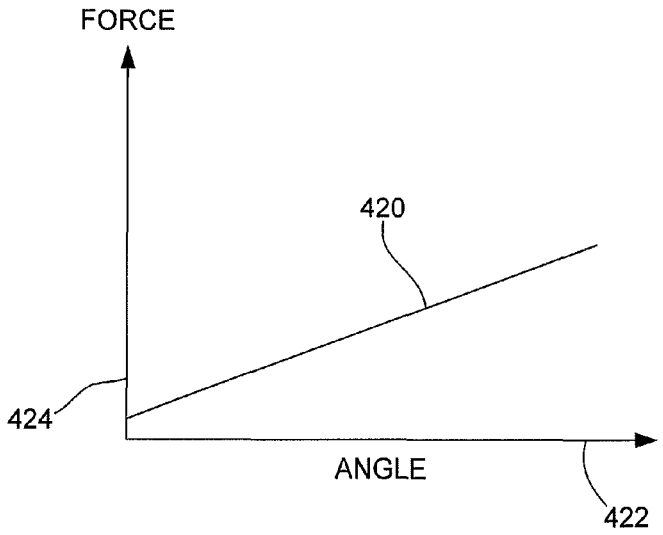
FIG. 4D is a graphical representation of a rotational deflection curve for the sharpener of FIGS. 4A-4C to illustrate a linear relationship between force and rotational angle of the support member.

FIG. 4D is a graphical representation of a displacement curve 420 plotted against an angle x-axis 422 and an applied force y-axis 424. The curve 420 is nominally linear in shape since, generally, the amount of rotational deflection (more specifically, angular deflection) of the abrasive surface will be nominally directly proportional to the amount of applied force. The applied force will be understood to be net force with respect to the distance from the axis of rotation (shaft 408).

Figure 4E:
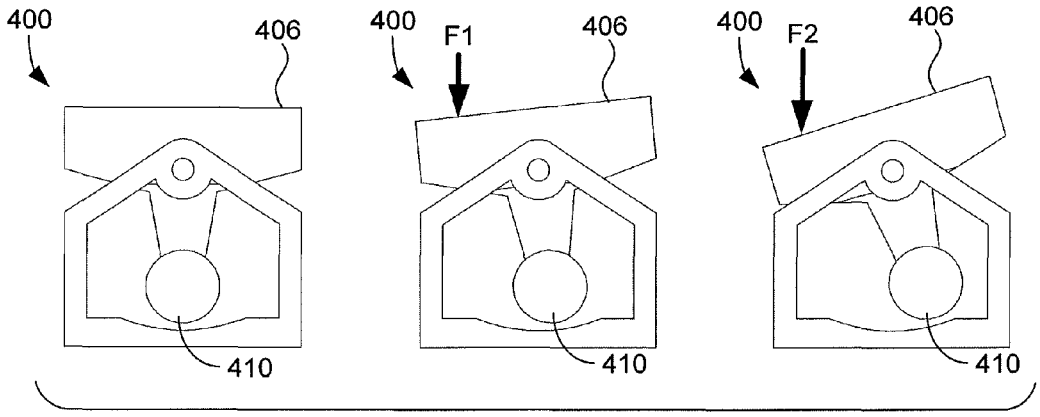
FIG. 4E shows different amounts of deflection applied to the sharpener of FIGS. 4A-4C in accordance with the deflection curve of FIG. 4D.

FIG. 4E shows the sharpener 400 with substantially no angular deflection, a relatively small amount of angular deflection induced by force F1, and a relatively large amount of angular deflection induced by force F2. Forces F1 and F2 may result from the same applied force from the user, but the relative location and areal extent of the cutting edge may result in a greater amount of net force for F2.

The sharpener 400 thus utilizes a simple gravity bias mechanism by way of the counterweight 410 to return the abrasive surface 406 to the neutral position. While effective, one limitation with this approach is that, once the support member 402 returns to the neutral position, the bias mechanism is balanced and hence, provides substantially little or no bias force upon the support member. Because of real world effects such as pivot bearing friction, there may be some small amount of rotational variation in the final neutral position from one stroke to the next.

Accordingly, FIGS. 5A-5D illustrate another manual sharpener 500 in accordance with some embodiments. The sharpener 500 is generally similar to the sharpeners discussed above and includes a base housing 502, support member 504 and abrasive surface 506. The support member 504 and abrasive surface 506 are rotatable with respect to the base housing 502 as before. As desired, the support member 504 can be configured to be reversible to provide a second abrasive surface 508 that can be rotated to the top position as required.

An upper guide surface 510 and a lower guide surface 512 are provisioned at opposing ends of the base housing 502 to facilitate respective leading edge and trailing edge sharpening operations as discussed above in FIG. 1C.

A cam assembly 514 (FIG. 5B) is incorporated into the housing 502 to provide a biasing mechanism upon the abrasive surface. The cam assembly includes a biased cam mechanism with a pair of cam surfaces 516, 518 that track a cam follower 520 (best viewed in FIG. 5D). A biasing member 522, such as in the form of a coiled spring, opposes displacement of the cam mechanism away from a neutral position corresponding to the horizontal orientation in FIG. 5A.

Figure 5A:
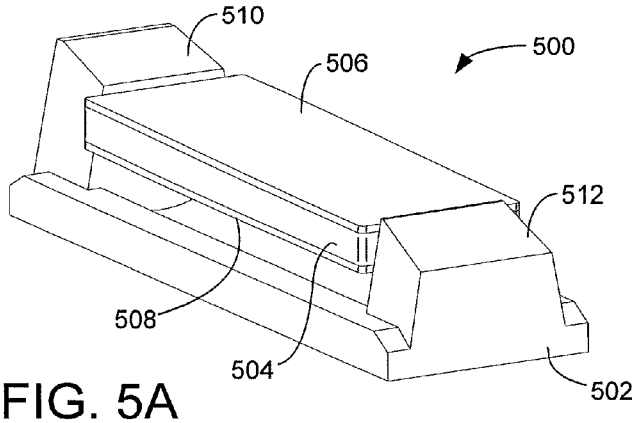
FIG. 5A is an isometric depiction of another tool sharpener similar to that of FIGS. 1A and 1B that uses a cam mechanism to control rotation of the support member.
Figure 5B:
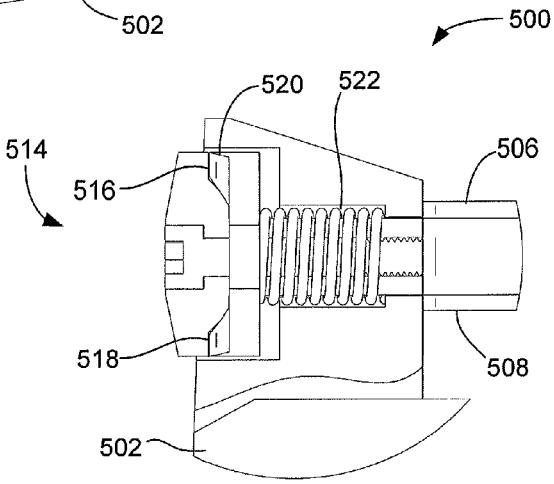
FIG. 5B is a cross-sectional, elevational view of the cam mechanism of the tool sharpener of FIG. 5A.
Figure 5C:
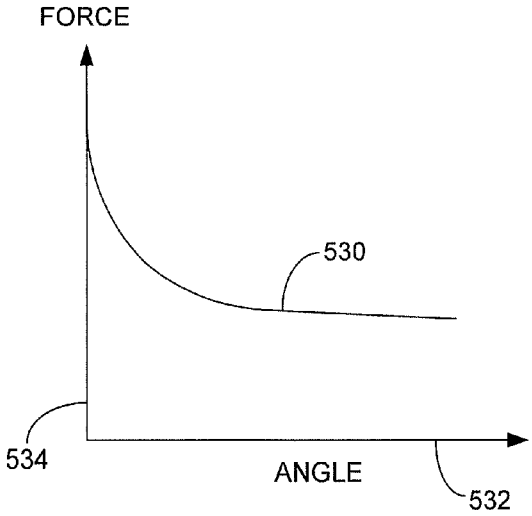
FIG. 5C is a graphical representation of a rotational deflection curve for the sharpener of FIG. 5A to illustrate a curvilinear relationship between force and rotational angle of the support member.
Figure 5D:
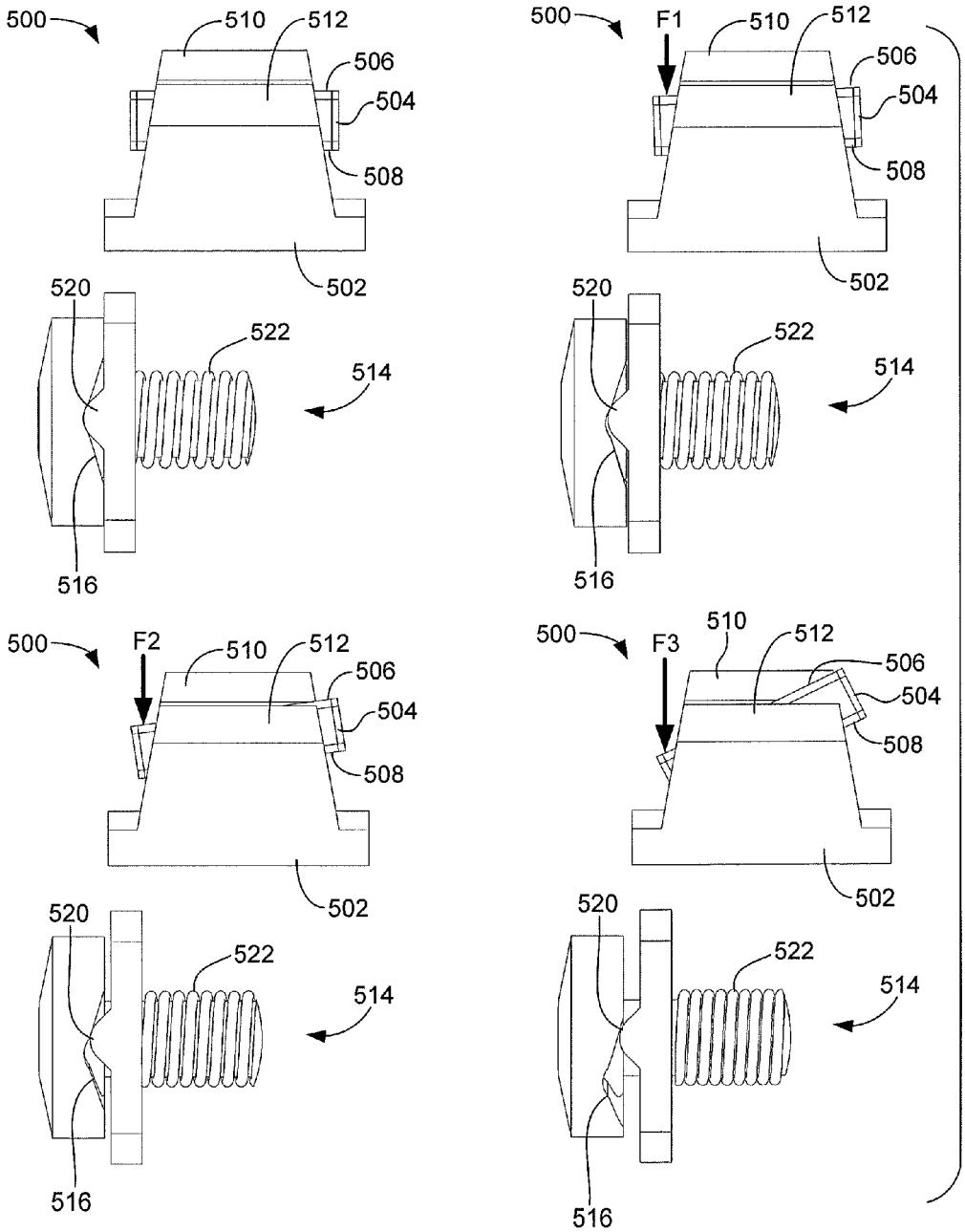
FIG. 5D shows different rotational angles and cam mechanism positions corresponding to FIG. 5C.

Displacement curve 530 in FIG. 5C generally illustrates the deflection characteristics of the abrasive surface 506. The curve 530 is plotted against a deflection angle x-axis 532 and a force y-axis 534, and takes a curvilinear shape. From FIG. 5C it can be seen that initial deflection of the abrasive surface requires substantially more net deflection force as compared to subsequent deflection. A sequence of deflection angles is represented in FIG. 5D for successively applied increasing net forces F1, F2 and F3.

Alternate cam surfaces and biasing members can be used to tailor the deflection curve 530 to a desired profile. In one embodiment, the abrasive surface 506 has a relatively high level of abrasiveness and may comprise, for example, a diamond embedded surface. The abrasive surface 508 may have a relatively low level of abrasiveness and may comprise a leather strop. In such case, the respective cam surfaces 516 and 518 may have different shapes to provide different amounts of resistive force to the rotation of the associated abrasive surfaces 506, 508. By way of illustration, a greater reactive force may be applied by the cam mechanism during sharpening against surface 506 as compared to surface 508.

FIGS. 6A-6D illustrate yet another manual sharpener 600 in accordance with some embodiments. The sharpener 600 is similar to the sharpeners discussed above and includes a base housing 602, a first support member 604 with a first abrasive surface 606 and a second support member 604A with a different, second abrasive surface 606A. The respective support members 604, 604A are interchangeable with the base housing 602 to present different abrasiveness levels for different sharpening operations.

Figure 6A:
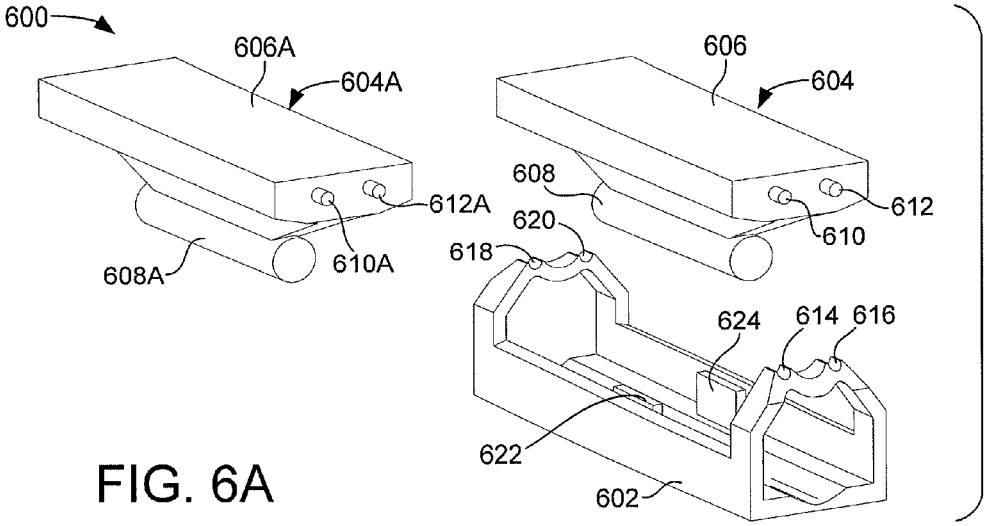
FIG. 6A is an exploded, isometric depiction of another tool sharpener similar to that of FIGS. 1A and 1B that uses a symmetric quad (four) shaft arrangement to control rotation of the support member.
Figure 6B:
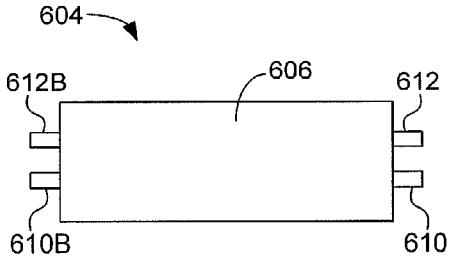
FIG. 6B shows a top plan view of the support member of FIG. 6A.

The support members 604, 604A each further include respective counterweights 608, 608A and four (4) support pins, two of which are visible in FIG. 6A for each support member. The visible support pins are respectively denoted as pins 610, 612 on support member 604 and 610A, 612A on support member 604A. For reference, FIG. 6B shows a top plan view of the support member 604 with opposing support pins 610, 612 and 610B, 612B.

The pins are symmetric about a central axis of the respective abrasive surfaces and nest within corresponding grooves 614, 616, 618 and 620 of the base housing 602. For reference, this four point support configuration is referred to herein as a "quad-configuration." It will be noted that the sharpener 100 of FIG. 1 also employs this same quad-configuration, so that the respective sharpeners 100, 600 are substantially similar and have the same nominal performance characteristics.

While the pins are shown to extend from the support member to nest within the corresponding grooves, in other embodiments this arrangement is reversed so that the pins are coupled to the housing and the grooves are formed in the support member. Other numbers of pins can be used. At least three pins can be used to define a plane along which the abrasive surface rests. The at least three pins can be symmetric or asymmetric about the central axis about which the surface rotates. While the pins are equal sized and characterized as cylindrical members, other sizes and shapes of the pins can be used, including pins of different sizes and/or shapes on the same or opposite sides of the abrasive surface.

Limit stops 622, 624 are further provided in the base housing 602 as shown to limit the amount of displacement of the counterweights 608, 608A.

Figure 6C:
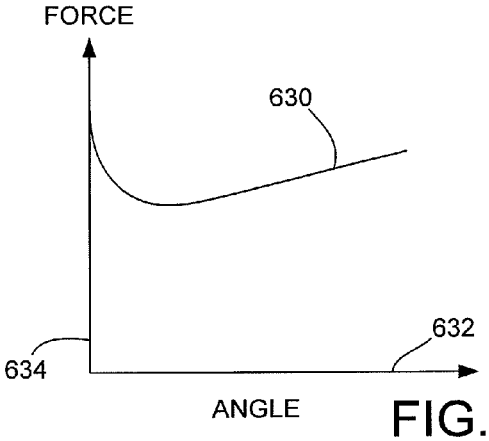
FIG. 6C is a graphical representation of a rotational deflection curve for the sharpener of FIG. 6A to illustrate a curvilinear relationship between force and rotational angle of the support member.

Displacement curve 630 in FIG. 6C provides an upwardly extending, curvilinear displacement profile for the sharpener 600. Both support members 604, 604A will tend to follow this same profile. The curve 630 is plotted against a displacement angle x-axis 632 and a net applied force y-axis 634.

Figure 6D:
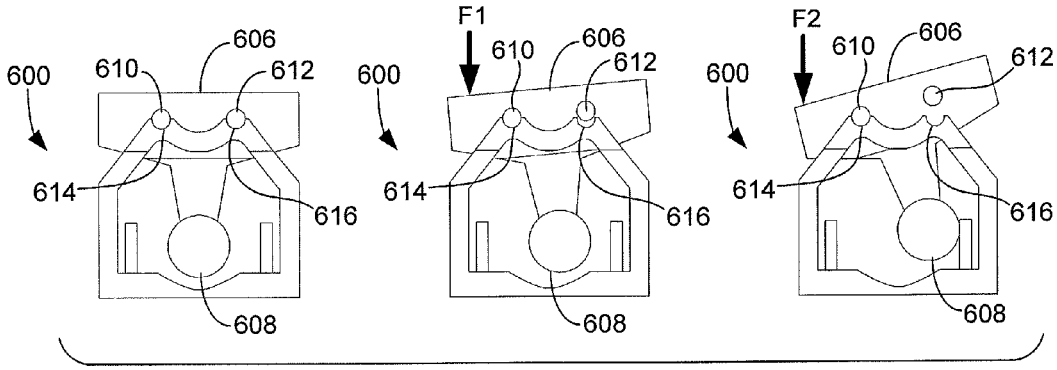
FIG. 6D shows different rotational angles of the support member corresponding to FIG. 6C.

The unique profile of the curve 630 is achieved through the two-stage compound rotation induced by the quad-configuration. As represented in FIG. 6D, an initial force F1 is required to initiate the unseating of a selected pin (in this case, pin 612) from its corresponding support groove (in this case, groove 616). Once unseated, the support member 604 continues to pivot about an offset axis defined by pin 610 and groove 614. Similar compound rotation occurs on the opposing side of the support member 604, as well as on both sides of the second support member 604A. An advantage of the quad-configuration of the sharpeners 100, 600 is that the neutral position is repeatable since this is established by the nesting of the pins within the corresponding support grooves. While four pins are shown, other total numbers of pins can be used including odd numbers of pins.

As before, the abrasive surface 606 may have a first abrasiveness level, such as a relatively higher level, and the abrasive surface 606A may have a different, second abrasiveness level, such as a relatively lower level. The respective counterweights 608 and 608A can be accordingly provided with different overall weights to accommodate the different abrasiveness levels. For example, the counterweight 608 may be heavier (e.g., steel) and the counterweight 608A may be lighter (e.g., aluminum). In such case, the overall dimensions and locations of the counterweights can be the same. In other cases, the respective sizes, shapes and/or locations of the counterweights can be varied as desired to provide the requisite reactive forces for the corresponding abrasive surfaces.

FIGS. 7A-7D illustrate yet another manual sharpener 700 in accordance with some embodiments. The sharpener 700 is similar to the sharpeners discussed above and includes base housing 702, support member 704 and abrasive surface 706. The support member 704 includes a counterweight 708 and four (4) support pins 710, 712, 714 and 716.

Figure 7A:
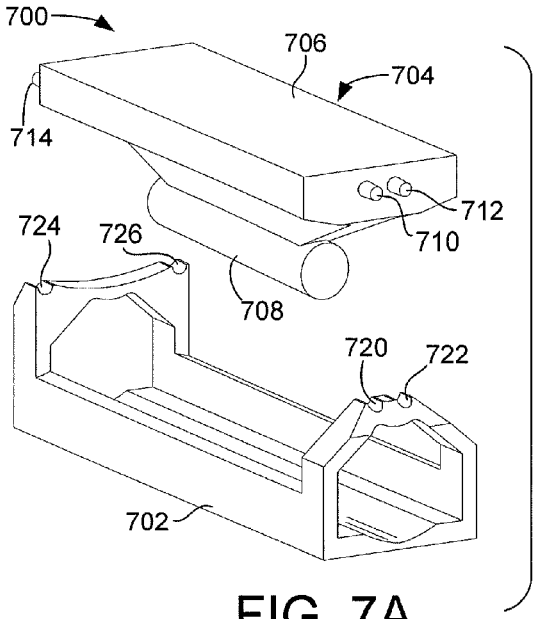
FIG. 7A is an exploded, isometric depiction of another tool sharpener similar to that of FIGS. 1A and 1B that uses an asymmetric quad (trike) shaft arrangement to control rotation of the support member.
Figure 7B:
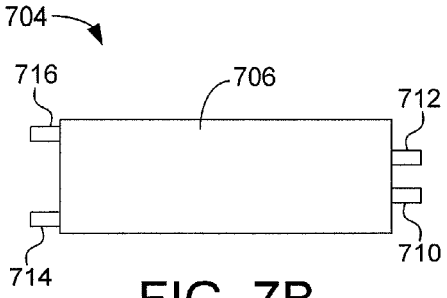
FIG. 7B is a top plan view of the support member of FIG. 7A.

The support pins 710, 712, 714 and 716 are best viewed in FIG. 7B, and nest in corresponding support grooves 720, 722, 724 and 726 in the base housing 702 (see FIG. 7A). A first pair of the support pins 710, 712 are closely spaced and a second pair of the support pins 714, 716 are spread apart, as shown. This provides a so-called "trike-configuration" as the pins roughly form a triangle. Other configurations are contemplated including a trike-configuration with a single centered pin instead of the pair of pins 710, 712.

Unlike the previously discussed sharpeners which are bi-directional and therefore sharpening operations can be initiated from either end, the sharpener 700 is configured to be uni-directional with sharpening operations beginning at the end with pins 714, 716. Directional indicia such as arrow 728 can be provisioned on the abrasive surface 706 or elsewhere to indicate to the user the preferred direction of sharpening.

Figure 7C:
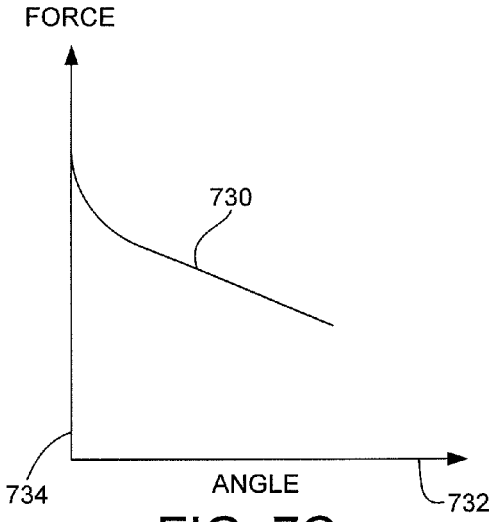
FIG. 7C is a graphical representation of a rotational deflection curve for the sharpener of FIG. 7A to illustrate a curvilinear relationship between force and rotational angle of the support member.

This provides a displacement profile as generally indicated by displacement curve 730 in FIG. 7C. The curve 730 is plotted against a displacement angle x-axis 732 and a net applied force y-axis 734, and provides a downwardly depending, curvilinear shape. While not expressly denoted in FIG. 7C, it will be understood that, at least for the curve 730, the x-axis also corresponds to sharpening distance toward the second end (e.g., adjacent pins 710, 712).

Figure 7D:
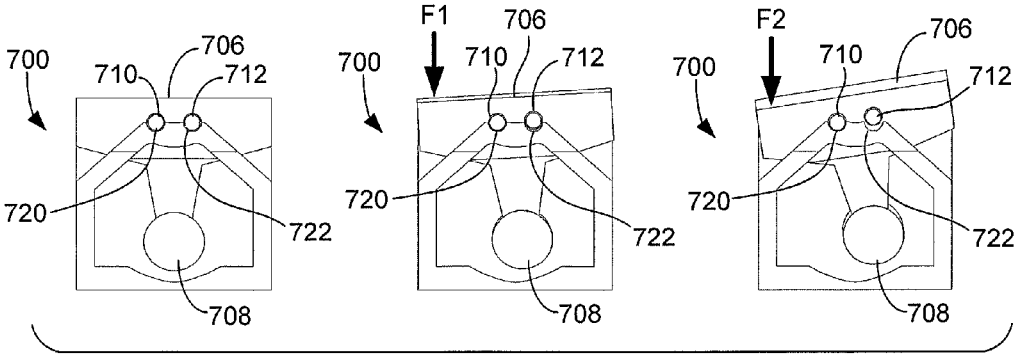
FIG. 7D shows different rotational angles of the support member corresponding to FIG. 7C.

As shown by the sequence of FIG. 7D, the sharpener 700 undergoes a complex rotational sequence similar to that for the sharpener 600 from a neutral position (no net applied force) to the successive application of forces F1 and F2. However, as the cutting edge approaches the distal end, the required force to rotate the support member 704 is decreased, as indicated by curve 730. It will further be noted that a slight, forward tilting of the abrasive surface 706 is imparted with greater amounts of applied force and corresponding rotation, as indicated by FIG. 7C. It will be noted that the axis about which the support member 704 rotates extends generally in the same direction as the length of the abrasive surface 706, although the axis is not parallel to this length direction as in FIG. 6.

Figure 8A:
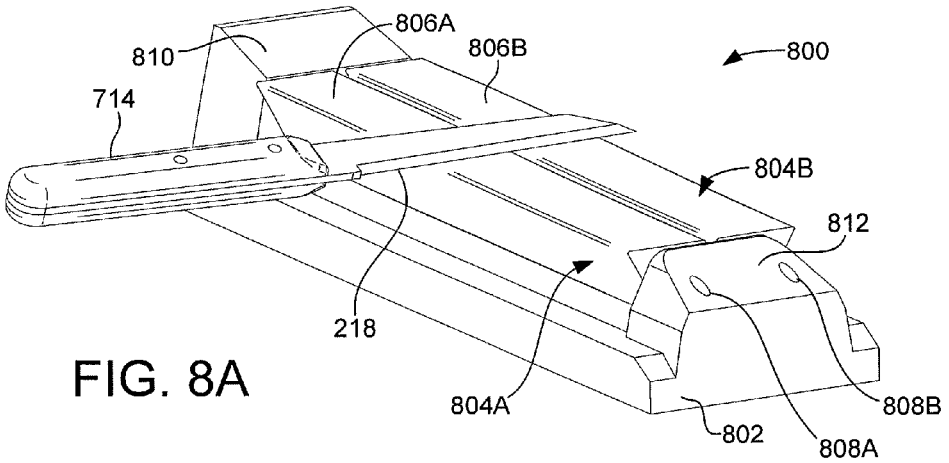
FIG. 8A is an isometric depiction of another tool sharpener similar to that of FIGS. 1A and 1B that uses multiple, independently rotatable support members.
Figure 8B:
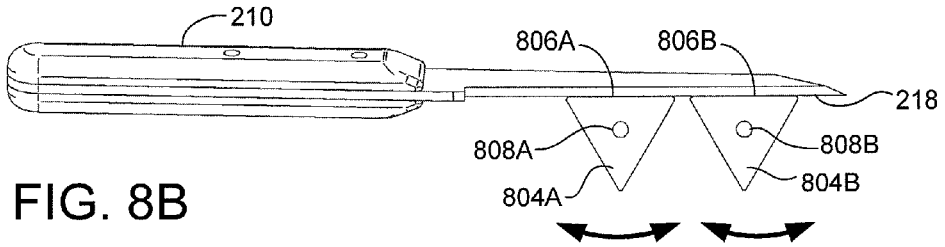
FIG. 8B shows the support members of FIG. 8A in greater detail.

FIGS. 8A and 8B show yet another manual sharpener 800 in accordance with some embodiments. The sharpener 800 is similar to the sharpeners discussed above and includes a base housing 802 and a pair of adjacent support members 804A, 804B. The support members are substantially triangular in shape, with each facing surface providing a different abrasive surface. Only the two abrasive surfaces are denoted in FIG. 8A as 806A and 806B.

The support members 804A, 804B are independently rotatable about respective shafts 808A, 808B. As before, the base housing 802 includes upper and lower guide surfaces 810, 812 to facilitate various sharpening operations. The cutting tool 210 discussed above is shown in conjunction with the sharpener 800, but it will be understood that any suitable cutting tools including tools such as those disclosed herein can similarly be sharpened.

As represented in FIG. 8B, the respective support members 804A, 804B are configured for independent rotation. While the support members are shown aligned due to the linear nature of the straight cutting edge 218, other cutting tools such as curvilinearly extending tool 220 would tend to induce independent rotation of the individual support members as required. It is contemplated that the sharpener relies on gravity bias and thus provides a substantially linear response as with the sharpener 400 discussed above. However, other biasing mechanisms, including cam mechanisms, trike or quad configurations, springs, etc. can be used as desired to bias the support members 804A, 804B to the neutral position.

Figure 9:
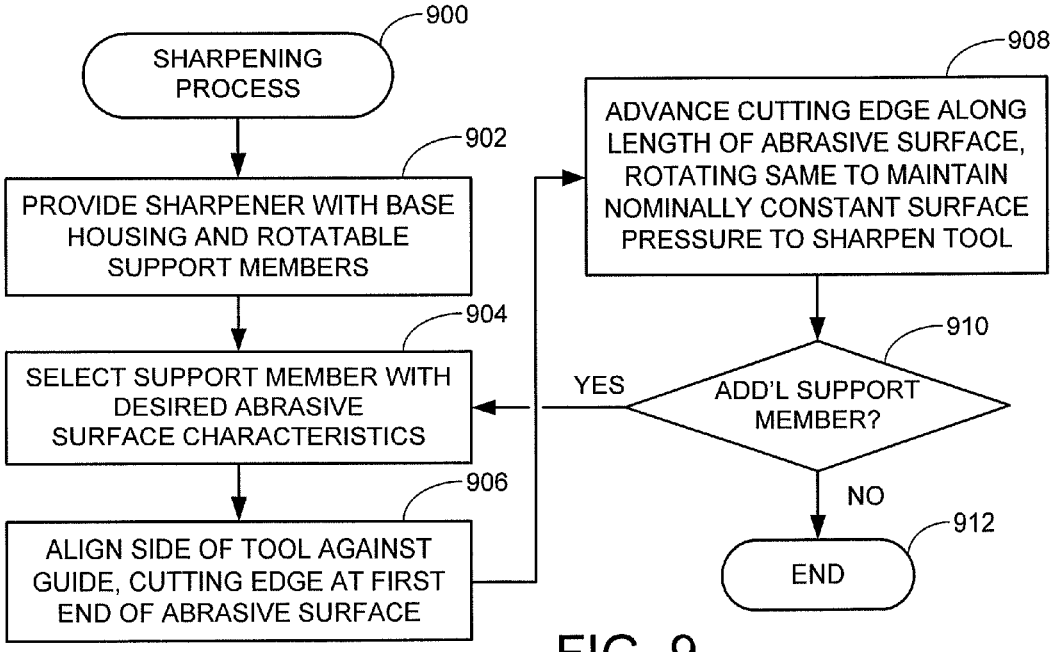
FIG. 9 is a flow chart for a sharpening process routine illustrative of steps carried to sharpen a cutting tool using the various embodiments of FIGS. 1A-8B.

FIG. 9 is a flow chart for a sharpening process routine 900 to summarize the foregoing discussion. The routine 900 generally describes a sharpening operation that can be carried out upon the cutting edge of a tool. Each of the respective sharpeners disclosed herein can be utilized during the routine. Nevertheless, the routine is merely illustrative and the various steps can be omitted, modified, appended, performed in a different order, etc.

The routine 900 begins at step 902 with the provision of a sharpener (such as the respective sharpeners 100, 200, 300, 400, 500, 600, 700 and/or 800) having a base housing with one or more rotatable support members each in turn having at least one abrasive surface.

For those sharpeners having multiple support members with different abrasive characteristics, such as but not limited to the embodiments of FIGS. 1, 6 and 8, the support member having the desired abrasive surface characteristics is selected and placed in the neutral position, as indicated at step 904.

At step 906, a side of the tool to be sharpened may next be placed against a suitable guide, including one of the upper or lower guides discussed above, and the cutting edge of the tool can be brought into contacting alignment against a first end of the abrasive surface.

The tool is next advanced at step 908 along the length of the abrasive surface while nominally maintaining the angle of the tool with that established by the reference guide. During the advancement of the tool, the abrasive surface rotates to nominally maintain a constant surface pressure against the tool. The amount of rotation will be governed at least in part by the relative location of the tool with respect to the axis of rotation of the abrasive surface. The biasing mechanism employed by the sharpener will oppose such rotation. While not necessarily required, it is contemplated that the user will nominally maintain a constant applied force against the abrasive surface, and the rotation will tend to remove a portion of the vertical (or other dimensional) component to maintain the surface pressure at a constant level, or at least below a maximum desired level as determined by the biasing mechanism.

The foregoing step may be repeated a number of times, such as 3-5 times on each side of the cutting tool. Decision step 910 determines whether an additional support member with a different abrasive surface is desired. If so, a new support member is installed or otherwise selected and the foregoing steps are repeated. This can be useful when applying multi-stage sharpening. In some cases, different guide angles may be applied during such different stages to provide a multi-faceted grind geometry to the tool. The sharpening process thereafter ends at step 912.

It will now be appreciated that the various embodiments disclosed herein can provide a number of advantages over the existing art. The manual sharpener as variously embodied provides a repeatable manual sharpening operation with repeatable characteristics. The automatic rotation of the abrasive surface in relation to the applied force encourages the user to limit the applied surface pressure, enabling fast and efficient sharpening of a wide variety of straight and curvilinearly extending cutting surfaces. The various guides can further facilitate repeatability during the sharpening operations.

Another feature of the various embodiments disclosed herein is the training aspect of the design. A user can be instructed to impart just enough force to the tool being sharpened to initiate movement of the abrasive surface. In this way, if no rotation is imparted, the applied surface pressure may be insufficient to adequately remove or reshape the tool material, so that the rotation can help to ensure that sufficient force is being applied to the tool for effective sharpening. Moreover, the bias mechanism can be altered to provide alternate levels of reactive force for different abrasiveness levels, thereby teaching the user how much force to apply for each abrasive to achieve optimal sharpening results. The movement of the abrasive surface further enables the user to more closely follow the profile of the cutting edge of the tool, particularly with curvilinearly extending cutting edges, since less upward tilting of the handle of the tool may be required as the profile of the cutting edge curves away from the handle.

It is to be understood that even though numerous characteristics and advantages of various embodiments of the present disclosure have been set forth in the foregoing description, together with details of the structure and function of various embodiments thereof, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A tool sharpener for sharpening a cutting tool having a cutting edge, the tool sharpener comprising:

a base housing adapted to be contactingly supported on a base surface, the base housing having an overall length dimension in a first direction;

a support member extending along the overall length dimension of the base housing and adapted for rotation with respect to the base housing about a central axis extending along the first direction;

an abrasive surface covering a top surface of the support member, the support member rotating the abrasive surface responsive to presentation of the cutting edge of the tool thereagainst as the cutting edge is moved along the abrasive surface in the first direction; and a biasing mechanism coupled to the support member and adapted to urge the support member to a neutral rotational position with respect to the base housing, the biasing mechanism comprising a counterweight coupled to the support member opposite the abrasive surface.

2. The tool sharpener of claim 1, further comprising at least one limit stop that contactingly engages a portion of the support member to limit a maximum rotational angle of the support member relative to the base housing.

3. The tool sharpener of claim 1, further comprising a locking mechanism which, when transitioned to a locked position, contactingly engages the support member to prevent said rotation of the support member relative to the base housing.

4. The tool sharpener of claim 1, further comprising a shaft coupled to the housing about which the support member rotates.

5. The tool sharpener of claim 1, wherein the support member is supported by a plurality of support pins which engage corresponding support grooves, wherein at least one of the pins is rotated out of the corresponding support groove during rotation of the support member relative to the base housing.

6. The tool sharpener of claim 5, wherein the support member is supported by at least three symmetrically aligned pins.

7. The tool sharpener of claim 5, wherein the support member is supported by at least three asymmetrically aligned pins.

8. The tool sharpener of claim 1, further comprising a guide surface supported by the base housing adjacent a first end of the abrasive surface, the guide surface extending at a selected angle to establish an angle of the cutting tool during the sharpening operation.

9. The tool sharpener of claim 8, wherein the guide surface is a surface of a removable guide member adapted for removable attachment with the base surface.

10. The tool sharpener of claim 1, wherein the base housing comprises opposing first and second end portions connected by a pair of elongated rails, and wherein the base sharpener further comprises a locking mechanism slidable along the pair of elongated rails between a locked position which impedes rotation of the support member and an unlocked position which facilitates rotation of the support member, the locking mechanism including opposing first and second limit stops that provide limit surfaces to limit maximum rotation of the support member in the unlocked position.

11. The tool sharpener of claim 1, wherein the support member is characterized as a first support member and the abrasive surface is characterized as a first abrasive surface having a first abrasiveness level, the tool sharpener further comprising a second support member having a second abrasive surface having a different, second abrasiveness level, the respective first and second support members alternately mateable with the base housing to carry out multi-stage sharpening upon the tool sequentially using the first and second abrasive surfaces.

12. The tool sharpener of claim 1, wherein the support member rotates about the central axis responsive to an applied force supplied to the cutting tool by the user and a relative location of a contact zone between the abrasive surface and the cutting edge of the tool with respect to the central axis to provide a nominally consistent surface pressure against the cutting edge of the tool.

13. The tool sharpener of claim 1, wherein the support member is characterized as a first support member and the abrasive surface is characterized as a first abrasive surface, the tool sharpener further comprising a second support member nominally identical to the first support member and supported by the base member adjacent the first support member, the second support member having a second abrasive surface with an abrasiveness level nominally identical to the first abrasive surface, the first and second support members individually rotatable with respect to the base housing during a sharpening operation upon the cutting tool.

14. A method for sharpening a cutting tool having a cutting edge, comprising:

placing a manual sharpener on a base surface, the sharpener comprising a base housing, a support member supported by the base housing and an abrasive surface supported by the support member, the support member and abrasive surface rotatable with respect to the base housing about a central axis, the abrasive surface in an initial neutral position;

placing the cutting edge into contacting engagement with the abrasive surface proximate a first end thereof;

advancing the cutting edge along a length of the abrasive surface in the direction of the central axis while drawing the cutting edge across the abrasive surface to rotate the abrasive surface with respect to the base housing responsive to a shape of the cutting edge thereby limiting a surface pressure applied to the cutting edge;

using a biasing mechanism of the sharpener to return the abrasive surface to the initial neutral position responsive to disengagement of the cutting edge from the abrasive surface;

removing the first support member from the base housing;

installing a second support member onto the base housing, the second support member supporting a second abrasive surface having a different, second abrasiveness level; and repeating the placing, advancing and using steps using the second support member.

15. The method of claim 14, further comprising aligning a side of the tool against a guide surface adjacent a first end of the abrasive surface to establish a selected angle between the tool and the abrasive surface, wherein the advancing step comprises nominally maintaining the tool at the selected angle as the cutting edge is advanced along the length of the abrasive surface.

16. The method of claim 14, further comprising supporting the support member relative to the base housing using a plurality of pins that extend into corresponding support grooves, wherein during the rotation of the support member at least a first pin is disengaged from the corresponding support groove and at least a second pin rotates within the corresponding support groove.

17. The method of claim 14, wherein the biasing mechanism comprises a counterweight supported by the support member opposite the abrasive surface.

18. A tool sharpener for sharpening a cutting tool having a cutting edge, the tool sharpener comprising:

a base housing adapted to be contactingly supported on a base surface, the base housing having an overall length dimension in a first direction;

a support member extending along the overall length dimension of the base housing and adapted for rotation with respect to the base housing about a central axis extending along the first direction;

an abrasive surface covering a top surface of the support member, the support member rotating the abrasive surface responsive to presentation of the cutting edge of the tool thereagainst as the cutting edge is moved along the abrasive surface in the first direction; and a biasing mechanism coupled to the support member and adapted to urge the support member to a neutral rotational position with respect to the base housing, the biasing mechanism comprising a cam assembly having a cam surface, a cam follower which contactingly travels along the cam surface responsive to rotation of the support member, and a biasing member which opposes said rotation.

19. The tool sharpener of claim 18, further comprising a shaft coupled to the housing about which the support member rotates.

20. The tool sharpener of claim 18, further comprising a guide surface supported by the base housing adjacent a first end of the abrasive surface, the guide surface extending at a selected angle to establish an angle of the cutting tool during the sharpening operation.

21. The tool sharpener of claim 18, wherein the abrasive surface is a first abrasive surface, and wherein the tool sharpener further comprises a second abrasive surface affixed to an opposing bottom surface of the support member, the support member further configured to rotate the second abrasive surface responsive to presentation of the cutting edge of the tool thereagainst as the cutting edge is moved along the second abrasive surface in the first direction.

22. The tool sharpener of claim 21, wherein the first abrasive surface has a first abrasiveness level and the second abrasive surface has a different, second abrasiveness level.

23. A tool sharpener for sharpening a cutting tool having a cutting edge, the tool sharpener comprising:

a base housing adapted to be contactingly supported on a base surface, the base housing having an overall length dimension in a first direction and comprising opposing first and second end portions connected by a pair of elongated rails;

a support member extending along the overall length dimension of the base housing and adapted for rotation with respect to the base housing about a central axis extending along the first direction;

an abrasive surface covering a top surface of the support member, the support member rotating the abrasive surface responsive to presentation of the cutting edge of the tool thereagainst as the cutting edge is moved along the abrasive surface in the first direction; and a locking mechanism slidable along the pair of elongated rails between a locked position which impedes rotation of the support member and an unlocked position which facilitates rotation of the support member, the locking mechanism including opposing first and second limit stops that provide limit surfaces to limit maximum rotation of the support member in the unlocked position.

24. The tool sharpener of claim 23, further comprising a biasing mechanism coupled to the support member and adapted to urge the support member to a neutral rotational position with respect to the base housing.

25. The tool sharpener of claim 24, wherein the biasing mechanism comprises a counterweight coupled to the support member opposite the abrasive surface, wherein the opposing first and second limit stops contactingly engage the counterweight to limit the maximum rotation of the support member in the unlocked position.

* * * * *